United States Patent [19]

Ayers

[11] 4,385,583

[45] May 31, 1983

[54] WORK PLATFORM

[75] Inventor: Ray R. Ayers, Houston, Tex.

[73] Assignee: Shell Oil Company, Houston, Tex.

[21] Appl. No.: 197,399

[22] Filed: Oct. 16, 1980

[51] Int. Cl.[3] ..... B63B 35/00

[52] U.S. Cl. ..... 114/265; 405/195; 405/208

[58] Field of Search ..... 405/195–210, 405/224; 175/5–9; 114/258, 259, 264, 265; 141/387, 388; 166/338, 368

[56] References Cited

U.S. PATENT DOCUMENTS

| | | | |
|---|---|---|---|
| 2,602,636 | 7/1952 | Travers | 405/196 X |
| 3,093,167 | 6/1963 | McCammon | 141/387 |
| 3,323,478 | 6/1967 | Hunsaker | 114/265 |
| 3,378,086 | 4/1968 | Kivisild | 175/7 |
| 3,435,571 | 4/1969 | Oltermann et al. | 405/202 X |
| 3,572,408 | 3/1971 | Hnot | 141/387 |
| 3,722,223 | 3/1973 | Gratz | 141/387 X |
| 3,765,463 | 10/1973 | Gassett et al. | 141/388 |
| 4,156,577 | 5/1979 | McMakin | 405/209 X |
| 4,217,848 | 8/1980 | Meyer-Haake | 405/196 X |
| 4,262,380 | 4/1981 | Foolen | 141/388 X |

FOREIGN PATENT DOCUMENTS

| | | | |
|---|---|---|---|
| 2008652 | 6/1979 | United Kingdom | 405/209 |

OTHER PUBLICATIONS

"The Technology of Offshore Drilling, Completion and Production" by ETA Seminars, Inc., 1976, p. 14.

"Manned Submersibles" by R. Frank Busby, 1976, p. 611, Office of the Oceanographer of the U.S. Navy.

*Primary Examiner*—Dennis L. Taylor

[57] ABSTRACT

A stable offshore platform for surface or undersea work is provided by connecting a semi-submersible trailer unit with a workboat. Preferably, two columns of the trailer are joined by a beam member or truss, and this assembly is linked to the workboat via a truss-like trailer tongue with a ball swivel joint. When in transit, the semi-submersible unit is deballasted to a shallow draft condition and towed by the workboat.

22 Claims, 4 Drawing Figures

25
25
10
17
9
18
16
24
28
17
20
29
16
19
11
14
11
21
30

12
22
24
10
25
20
17
9
24
21
23
11

WORK PLATFORM

BACKGROUND OF THE INVENTION

Many thousands of vessels form a fleet of marine transportation boats serving companies working in offshore waters throughout the world. The vast majority of these vessels support offshore oil and gas exploration and production activities. Most of these vessels are classed as tugboats, supply boats, or crew boats, and have displacement type hulls. A common problem with such hulls is that it is difficult for men to perform useful work from the decks thereof due to waves which wet the decks and which cause excessive roll and pitch motions of the vessels. Weather in the Gulf of Mexico is occasionally severe enough to hinder or delay operations, but weather in the North Sea is so severe as to have a significant impact on operations from such vessels. Transfer of men and equipment to offshore platforms, handling of anchor buoys, and deployment of men and equipment subsea are examples of operations wherein a safe and stable work platform is needed.

A potential solution to this problem is to build and use larger vessels. This slightly improves the situation, but at a significantly increased cost, and generally it is not considered an economically feasible approach.

Another potential solution is to build a fleet of small to medium sized, column-stabilized, semi-submersible vessels like the larger semi-submersible vessels used for drilling operations. These are stable work platforms having long natural periods of response in the order of 20 to 40 seconds. By contrast, a 200-foot supply boat has natural periods of from 6 to 9 seconds, which is quite close to the period range of highest wave energy. While such semi-submersibles would significantly reduce wave-induced motions and deck wetness, it would be at an excessive cost of retiring the conventional fleet and building a new and more expensive fleet.

SUMMARY OF THE INVENTION

The present invention generally pertains to a work platform including at least two connected semi-submersible flotation means, means for pivoting the flotation means, and connecting means extending between the flotation means and the pivoting means.

In a preferred embodiment, the flotation means is two connected pontoons, and the pivoting means is a ball swivel joint.

More generally, the present invention pertains to a stable offshore platform for surface or subsea work which is a semi-submersible unit attachable to a workboat or other support means. Pontoons of the semi-submersible unit are connected to the workboat or other support means via a gooseneck truss, trailer tongue or the like, and a ball swivel joint or the equivalent. When not in use, or in transit, the semi-submersible unit may be deballasted to ride high in the water and permit entrance to shallow harbors, or it may be hoisted over the workboat or other vessel or support means.

PREFERRED EMBODIMENT OF THE INVENTION

The present invention provides a new solution to problems of offshore handling and transfer operations in rough weather. Generally, the invention is a semi-submersible, gooseneck style trailer work platform which is towable by a conventional vessel such as a supply boat, or by other means. The trailer/work platform is pivotable from a raised or hoisted transit mode to a lowered or partially submerged working mode. With the floating semi-submersible trailer/work platform, workmen can safely climb aboard from a supply boat, rig, or other vessel and do useful work on a stable, dry deck. Further, using the present invention, men and equipment can be easily and safely transferred subsea or upward to an offshore platform or larger floating vessel.

Figure 1:
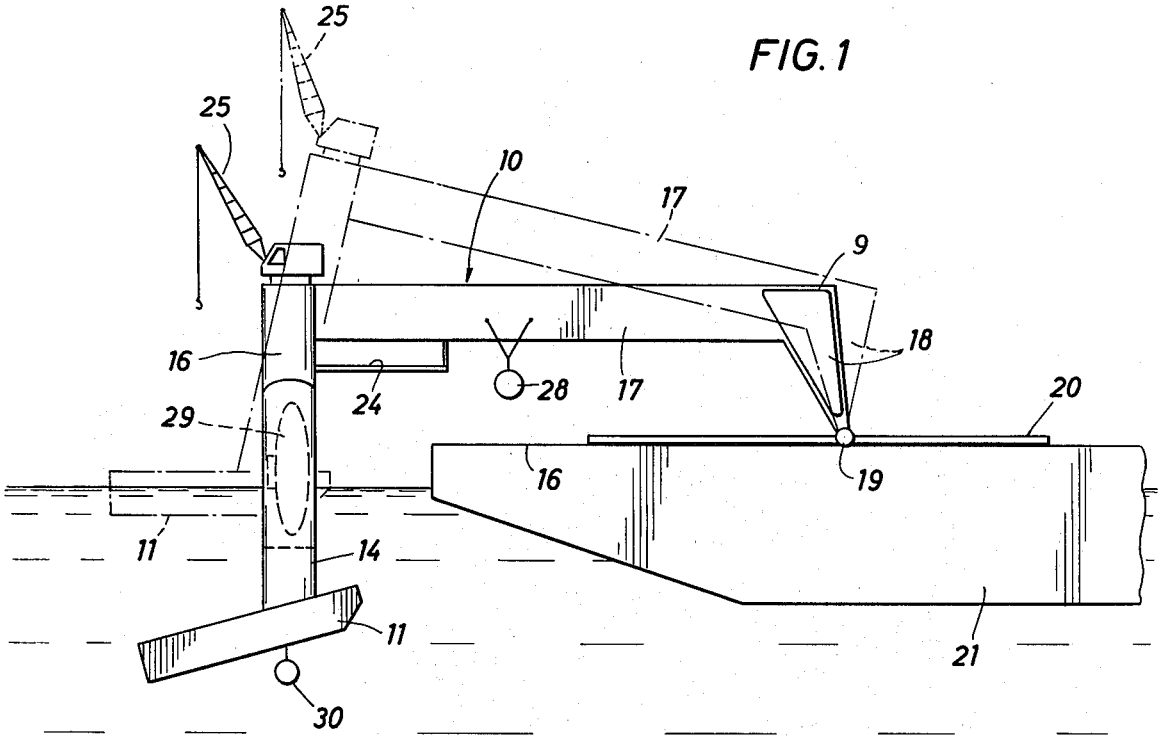
FIG. 1 discloses a side view of the apparatus of the present invention.
Figure 2:
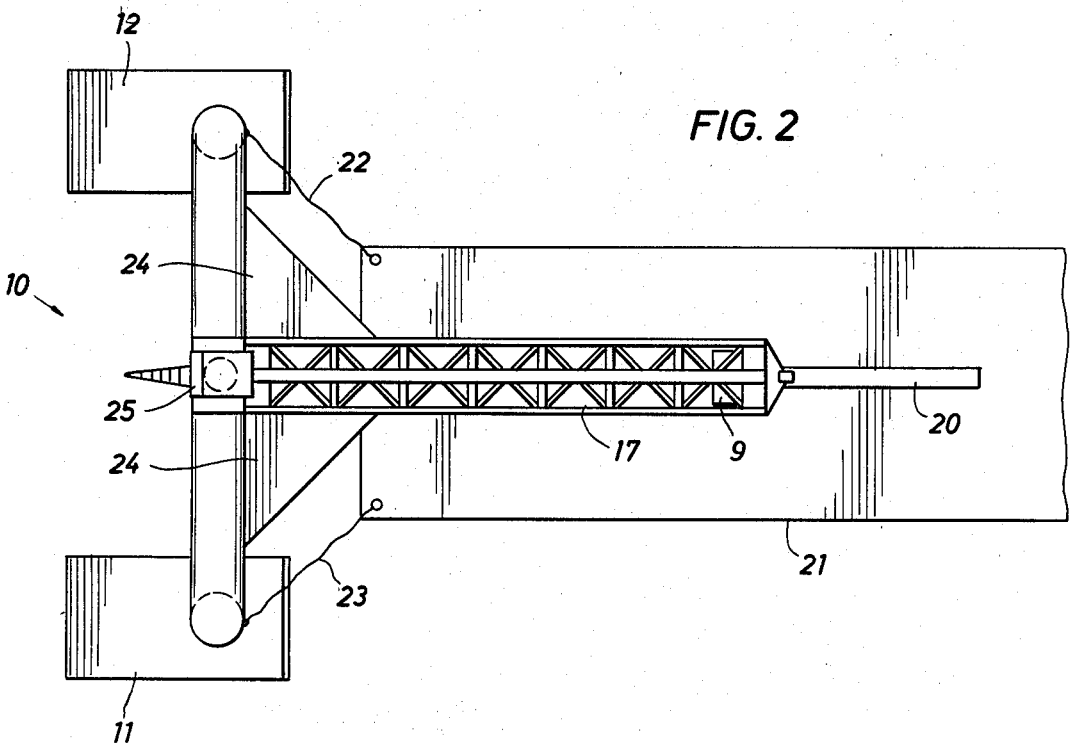
FIG. 2 provides a plan view.
Figure 3:
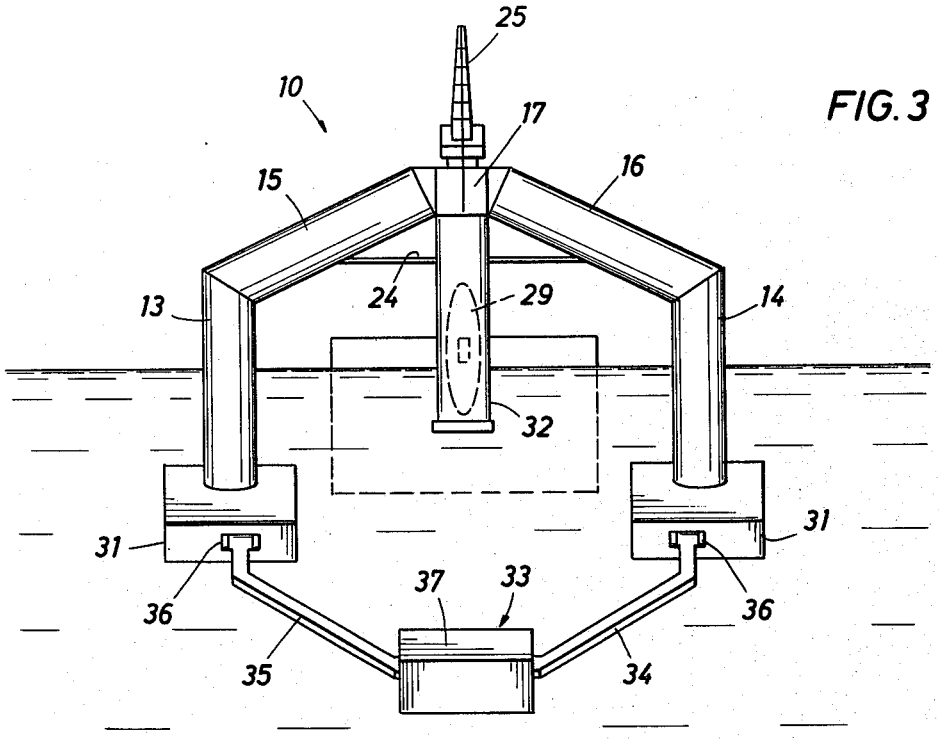
FIG. 3 provides a view from astern.

As shown in FIG. 1, the semi-submersible trailer/work platform 10 includes pontoons 11 and 12 which may be in a lowered position for work use or in a partially raised position (as shown in phantom) for transit. Alternatively, the pontoons may be hoisted over the vessel or other support means. Pontoons 11 and 12 are at the ends of two vertical columns 13 and 14 which in turn are connected by slanted cross beams 15 and 16 which abut pivoting framework 17. Vertical beam 18 extends downwardly from the opposite end of framework 17 to a ball swivel joint 19, or the like, which in turn can be mounted on a track or slot 20 so that it can be moved forward or aft, or even released aft in an emergency. If the trailer/work platform is released, buoyancy 9 in beam 18 provides sufficient flotation to prevent the trailer/work platform from overturning. The buoyancy 9 may be a water tight compartment, tankage, foam, etc.

For best motion response with platform 10 in a working mode, ball swivel joint 19 is located at the center of pitch of the supply vessel or other support means 21 to which it is attached. For storm survival, ball swivel joint 19 can be moved aft to minimize the risk of the underside of the pivoting means or framework 17 contacting the stern of vessel 21 while the vessel is pitching in severe waves. Alternatively, or in addition, the trailer/work platform 10 can be deballasted to a light condition as shown in phantom in FIG. 1 for storm survival. Low tension tieback ropes, chains or cables 22 and 23 are used to insure that the trailer/work platform does not jackknife into contact with the vessel or other support means.

The trailer/work platform 10 can take many forms, depending on the specific application. Thus, it can have an aft deck 24 to support workmen or it can be used for offloading to platforms. Crane 25 may be used for offloading to platforms, etc. not having cranes, but it generally is preferred to use other cranes when available. The trailer/work platform can have various other lifting means such as gantry hoist 28 for lifting loads from supply vessel deck 26 to work platform 24 or to move equipment and/or personnel subsea. Also, the trailer/work platform can have submarine operations 29 by having special launch/recovery equipment. Although submarines can be launched from the platform in various ways, it is preferred to launch from a duct 32 between pontoons 11 and 12. This facilitates getting the submarine through the wave/air interface, hence the cylindrical duct 32 to guide the submarine in and out of the water. Alternatively, an elevator may be used to lift and lower the submarine. Although it is prudent to keep the trailer/work platform simple, thrusters 30 can be placed in pontoons 11 and 12 and extended downward for operation to aid in offloading operations, then retracted when not in use.

Just like other semi-submersibles, the trailer/work platform 10 can be towed out in a shallow draft, low ballast condition and then be ballasted down at the work site to perform required work. By towing the trailer/work platform in a lightened condition, the reduction in tow vessel speed due to the trailer is normally small, and shallow harbors can be used. In the lightened mode, the trailer/work platform 10 has the performance of a displacement type catamaran. Once the trailer/work platform is ballasted down with equipment weight and/or by water 31, the favorable long period semi-submersible characteristics above mentioned appear.

Figure 4:
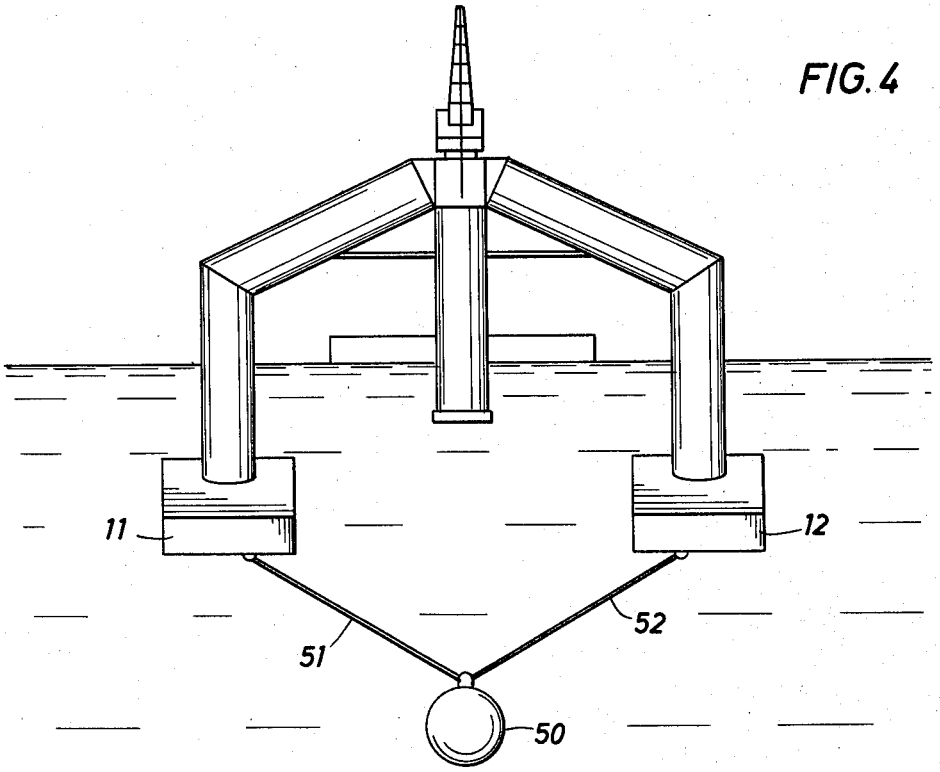
FIG. 4 discloses a modification of the embodiment of FIG. 3.

A floodable chamber 33 may be attached to pontoons 11 and 12 by beams 34 and 35 and hinges 36 in order to provide added stability to the semi-submersible. The amount of ballast in chamber 33 is adjustable by changing water level 37. This chamber provides more righting moment in roll of the semi-submersible. Alternatively, a dead weight 40 may be suspended by cables 41 and 42 from pontoons 11 and 12 as shown in FIG. 4.

EXAMPLES

The present invention was tested at 1/50th scale in a wave tank, using a simulated 2000-ton prototype supply vessel and a simulated 350-ton trailer/work platform, the trailer/work platform was calm and stable in 12 and 25 foot waves with wave lengths 20 times the wave height while the bow moored vessel was excessively pitching and rolling. Natural periods for prototype roll and heave for the trailer/work platform were in the 15 to 35 second range. For this combination of trailer/work platform and vessel, useful work could be done in wave heights to about 20 feet. The vessel/trailer/work platform combination tracked well under tow in both light and heavy ballast conditions. Based on estimations, light ballast condition would only reduce the normal vessel transit speed by no more than one knot.

PRIOR ART

U.S. Pat. No. 3,323,478 discloses a method of joining two vessels of conventional shape using spreader bars and tie lines, with a truss work between the vessls supporting a drilling rig. The joined vessels are like a hinged catamaran and not like a semi-submersible vessel as used with the present invention and as shown in *The Technology of Offshore Drilling, Completion and Production* by ETA Offshore Seminars, Inc., 1976, page 14. In the present invention the trailer is at the stern of the towing vessel, as opposed to alongside the vessel. Also, the present invention is structurally joined to the towing vessel with a single ball swivel joint and not the complicated means shown in U.S. Pat. No. 3,323,478.

*The Technology of Offshore Drilling* (above cited, page 14) shows a typical semi-submersible vessel commonly seen in rough weather areas like the North Sea as well as in more moderate weather climates. These vessels are free standing, either self propelled and positioned with thrusters or non-self propelled and moored in position to do work. If the semi-submersible is not self propelled, it is towed to its work location by tow vessels using tow lines between the tow vessels and the semisubmersible vessel. Thus, the semisubmersible is handled like a conventional barge. By comparison with a free standing semisubmersible, the semisubmersible of the present invention has one corner supported by a structural ball swivel joint on the deck of a tow vessel. So, in effect, the semisubmersible of the present invention is like a trailer at the rear of the tow vessel and is markedly dissimilar to a free standing semisubmersible.

*Manned Submersibles* by R. Frank Busby, 1976, page 611, Office of the Oceanographer of the U.S. Navy, shows how a spar buoy assembly can be connected alongside a floating vessel by way of a single-degree-of-freedom hinge (like a door hinge). This assembly then can be used to support operations of a subsea nature. By comparison with the present invention, (a) the spar buoy assembly is positioned alongside the vessel and not behind it; (b) the spar buoy assembly has no submerged pontoon below water to permit heavier lifts, (c) the hinge point of the spar buoy assembly is well above the vessel deck so that roll motion of the vessel is amplified into a sizable transverse motion and rotation of the spar buoy assembly, (d) the hinge of the spar buoy assembly is a simple one-degree-of-freedom hinge and not a ball swivel hinge having three degrees of freedom as in the present invention and (e) there is only one flotation means (a spar buoy) whereas a minimum of two flotation means (columns plus pontoons) is utilized by the present invention. Hence, there are few similarities between the present invention and the spar buoy assembly.

What is claimed is:

1. A semi-submersible trailer attachable to a vessel comprising a work platform, at least two connected semi-submersible flotation means supporting the platform, means for pivoting the trailer up to a transit mode and down to a work performance mode, and connecting means extending between the trailer and the pivoting means.

2. The trailer of claim 1 wherein the pivoting means comprises a swivel joint capable of permitting the trailer to move up and down and side to side.

3. The trailer of claim 1 wherein the flotation means comprises pontoons.

4. The trailer of claim 1 wherein the connecting means comprises at least one truss.

5. The trailer of claim 1 wherein the pivoting means is attached to floating support means.

6. The trailer of claim 5 wherein the support means is a vessel.

7. The trailer of claim 1 wherein the pivoting means is attached to non-floating support means.

8. The trailer of claim 7 wherein the support means is a dock.

9. The trailer of claim 2 including tie lines connecting each flotation means to means supporting the pivoting means.

10. The trailer of claim 1 including means for ballasting the pontoons.

11. The trailer of claim 2 wherein the swivel joint is mounted on a floating vessel at least near the center of pitch on the deck of the vessel.

12. The trailer of claim 1 wherein supply moving means is operatively engaged with the connecting means to move supplies between means supporting the pivoting means and the area about the flotation means.

13. The trailer of claim 1 wherein thrusters are positioned within and beneath the pontoons.

14. The trailer of claim 2 wherein the swivel joint is releasably mounted on moving means.

15. The trailer of claim 14 wherein the moving means is a track extending longitudinally on support means.

16. The trailer of claim 14 wherein the moving means is a slot extending longitudinally on support means.

17. The trailer of claim 1 including ballast means deployable from the flotation means.

18. The trailer of claim 17 wherein the ballast means is a floodable chamber.

19. The trailer of claim 1 including a deck.

20. The trailer of claim 1 including a crane.

21. The trailer of claim 1 including launch/recovery means for a submarine.

22. The trailer of claim 1 wherein the connecting means includes flotation means.

* * * * *